US006620460B2

(12) United States Patent
Oldiges et al.

(10) Patent No.: US 6,620,460 B2
(45) Date of Patent: Sep. 16, 2003

(54) METHODS FOR USING ENVIRONMENTALLY FRIENDLY ANTI-SEIZE/LUBRICATING SYSTEMS

(75) Inventors: Donald A. Oldiges, Cypress, TX (US); Anthony W. Joseph, Houston, TX (US)

(73) Assignee: Jet-Lube, Inc., Houston, TX (US)

( * ) Notice: Subject to any disclaimer, the term of this patent is extended or adjusted under 35 U.S.C. 154(b) by 0 days.

(21) Appl. No.: 10/161,242

(22) Filed: May 31, 2002

(65) Prior Publication Data

US 2002/0182331 A1 Dec. 5, 2002

Related U.S. Application Data

(62) Division of application No. 08/948,551, filed on Oct. 10, 1997, now abandoned, which is a continuation of application No. 08/597,585, filed on Feb. 2, 1996, now abandoned, which is a continuation of application No. 08/237,263, filed on May 3, 1994, now abandoned, which is a continuation-in-part of application No. 08/156,449, filed on Nov. 23, 1993, now abandoned, which is a continuation of application No. 07/870,132, filed on Apr. 15, 1992, now Pat. No. 5,286,393.

(51) Int. Cl.[7] ..... B05D 1/00; B05D 3/02
(52) U.S. Cl. ..... 427/409
(58) Field of Search ..... 427/409

(56) References Cited

U.S. PATENT DOCUMENTS

| | | | | |
|---|---|---|---|---|
| 1,586,087 | A | | 5/1926 | Howe et al. |
| 2,419,144 | A | | 4/1947 | Kelly |
| 2,537,629 | A | | 1/1951 | Brown |
| 2,540,003 | A | | 1/1951 | McCoy |
| 2,543,741 | A | | 2/1951 | Zweifel |
| 2,581,301 | A | * | 1/1952 | Saywell ..... 508/105 |
| 2,600,367 | A | | 6/1952 | Stirn et al. |
| 2,754,266 | A | | 7/1956 | Stegemeier et al. |
| 3,423,315 | A | | 1/1969 | McCarthy et al. |
| 3,514,400 | A | | 5/1970 | Hotten |
| 3,652,414 | A | | 3/1972 | Bergeron |
| 3,652,415 | A | | 3/1972 | Bergeron |
| 3,710,620 | A | | 1/1973 | Brandeau et al. |
| 3,736,167 | A | | 5/1973 | Bachman et al. |
| 3,784,264 | A | | 1/1974 | Jackson, Jr. |
| 3,801,506 | A | | 4/1974 | Cross et al. |
| 3,835,517 | A | | 9/1974 | Walters |
| 3,843,528 | A | | 10/1974 | Bailey et al. |
| 3,935,114 | A | | 1/1976 | Donaho, Jr. |
| 4,063,346 | A | | 12/1977 | Simpson et al. |
| 4,105,812 | A | | 8/1978 | Campbell, Jr. |
| 4,155,860 | A | | 5/1979 | Soucy |
| 4,256,811 | A | | 3/1981 | Black |
| 4,329,238 | A | | 5/1982 | Mitrofanova et al. |
| 4,358,384 | A | | 11/1982 | Newcomb |
| 4,379,062 | A | | 4/1983 | Preagaman |
| 4,379,738 | A | | 4/1983 | Kohl |
| 4,381,228 | A | | 4/1983 | Teichmann et al. |
| 4,407,149 | A | | 10/1983 | Smith et al. |
| 4,500,864 | A | | 2/1985 | Nakane et al. |
| 4,501,776 | A | | 2/1985 | Shankar |
| 4,525,287 | A | | 6/1985 | Carstensen |
| 4,555,445 | A | | 11/1985 | Frey et al. |
| 4,608,742 | A | | 9/1986 | Ferguson et al. |
| 4,654,230 | A | | 3/1987 | Coch |
| 4,655,884 | A | | 4/1987 | Hills et al. |
| 4,790,471 | A | | 12/1988 | Turner |
| 4,803,127 | A | | 2/1989 | Hakim |
| 4,946,747 | A | | 8/1990 | Bergmann et al. |
| 5,093,015 | A | | 3/1992 | Oldiges |
| 5,217,751 | A | | 6/1993 | King et al. |
| 5,219,815 | A | | 6/1993 | Krulik et al. |
| 5,242,572 | A | | 9/1993 | Shindou et al. |
| 5,248,475 | A | | 9/1993 | Feldstein |
| 5,271,546 | A | | 12/1993 | Hardwick |
| 5,273,775 | A | | 12/1993 | Dyer et al. |

FOREIGN PATENT DOCUMENTS

| | | |
|---|---|---|
| JP | 55082196 | 12/1978 |

OTHER PUBLICATIONS

"Bulletin on Thread Compounds for Casing, Tubing, and Line Pipe"; American Petroleum Institute, API Bulletin 5A2 (Bul. 5A2), Sixth Edition, May 31, 1988.

* cited by examiner

*Primary Examiner*—Erma Cameron
(74) *Attorney, Agent, or Firm*—Robert W. Strozier

(57) ABSTRACT

A method for imparting anti-seize protection and lubricant to threaded connections of protection during make-up and break-out is disclosed which includes adhering a metallic anti-seize film to threads of threaded connections and coating the film protected threads with a lubricating composition to form an anti-seize/lubricating system with reduced adverse environmental impact. The method can also include depositing a bonding film or layer onto the threads prior to adhering the anti-seize film.

18 Claims, No Drawings

METHODS FOR USING ENVIRONMENTALLY FRIENDLY ANTI-SEIZE/LUBRICATING SYSTEMS

RELATING APPLICATIONS

This application is a divisional of U.S. patent application Ser. No. 08/948,551 filed Oct. 10, 1997 now abandoned, which is a continuation of U.S. patent application Ser. No. 08/597,585 filed Feb. 2, 1996, now abandoned, which is a continuation of U.S. patent application Ser. No. 08/237,263 filed May 3, 1994, now abandoned, which is a CIP of U.S. patent application Ser. No. 08/156,449 filed Nov. 23, 1993, now abandoned, which is a continuation of U.S. patent application Ser. No. 07/870,132, now U.S. Pat. No. 5,286, 393.

FIELD OF THE INVENTION

The present invention relates to methods for protecting and lubricating threaded connections such as, oil field tool joints, drill collars, casing, tubing, line pipe, flow lines, subsurface production tools and other threaded connections that are exposed or subjected to extremes of stress, temperature, and/or pressure. More particularly, the present invention relates to methods for adhering an anti-seize metallic film onto the surface of threads of threaded connections and for coating the anti-seize protected threads with an environmentally friendly lubricating composition providing an environmentally friendly anti-seize/lubricating system.

BACKGROUND OF THE INVENTION

Oil field thread forms require products with high film strength and a certain range in coefficient of friction. Because thread faces are often subjected to bearing stresses in excess of 50,000 psi, excessive rotation could result in bearing stresses capable of rupturing the protective film and leading to subsequent galling and damage to the pipe. Anti-seize compounds are used to protect against the damage that high bearing stresses may otherwise cause by providing a dissimilar metal or other material between like substrates. Such a compound inhibits the "welding" that may otherwise occur from the temperatures, pressures, and stresses normally incurred during proper make-up.

Conventionally used anti-seize thread compounds include greases which contain substantial amounts of heavy metals or their oxides, carbonates, or phosphates. Such metals include: copper, zinc, lead, nickel, molybdenum, and aluminum. Recent environmental regulations have begun to discourage, and in some cases prohibit, the use of anti-seize compounds that contain such materials. Organic fluid additives containing antimony, zinc, molybdenum, barium, and phosphorus have become the subject of environmental scrutiny as well.

Although it is becoming increasingly unacceptable to include such materials in anti-seize compounds, compounds that do not include them generally do not, by themselves, provide the film strength needed to protect threaded connections from galling or other damage, when subjected to high bearing stresses.

One of the reasons why such compounds are disfavored results from the way they are used. Oil field threaded connections are usually coated with an excess amount of the thread compound to ensure complete connection coverage. The excess compound is sloughed off and ends up downhole. It is then included with the other materials pumped out of the wellhole and into a containment area. From there, material contaminated with heavy metals must be removed to a hazardous waste disposal site.

There is a need for methods that protect threaded connections by adhering and coating an environmentally friendly anti-seize/lubricating system to the thread surfaces so that there is provided adequate protection against galling and other damage to threaded connections subject to high bearing stresses, such as those on oil field tool joints and drill collars and adequate lubrication for controlled make-up and break-out of the threaded connections. Such methods should provide environmentally friendly, yet adequate anti-seize film strengths and adequate lubrication to protect such threaded connections from galling or failure, to reduce additional downhole make-up, to reduce heavy metals leached, and to reduce the classification of the drilling fluids as hazardous waste due to heavy metal or other hazardous material contamination from the anti-seize/lubrication system. The methods of the present invention provide just such a system.

SUMMARY OF THE INVENTION

The present invention provides methods for protecting threaded connections including:

- adhering a protective metallic, anti-seize film coating to threads, prior to make-up; and
- coating the film protected threads with an environmentally friendly lubricating composition prior to make-up.

The present invention also provides methods for protecting threaded connections including:

- depositing a bonding metallic film to the threads, prior to make-up;
- depositing a protective metallic, anti-seize film on top of the bonding film, prior to make-up; and
- coating the film protected threads with an environmentally friendly lubricating composition prior to make-up;

where the bonding film is adapted to be interposed between the threaded surface and the anti-seize film and to simultaneously bond to the thread surface and to the anti-seize film.

The present invention further provides a method for protecting threaded connections comprising:

- coating the threads, prior to their make-up, with a solvent thinned resin based coating and bonding composition comprising a suspending agent, a bonding agent, a thinning agent, and a metallic flake;
- drying the coated threads for a time sufficient to bond the coating and bonding composition to the threads; and
- coating the threads, prior to their make-up, with an excess amount of an environmentally friendly lubricating composition.

With such methods, an anti-seize metallic film is adhered to the thread surface to provide anti-seize protection while minimizing the amount of metal released into the environment. In such methods, thread wear alone discharges metal into the environment. Metal contamination is thus substantially reduced, when compared to present methods that coat the threads with excess amounts of metal containing oil based lubricants, a significant amount of which may be leached into drilling mud and other fluids used in drilling operations. The use of anti-seize metallic films in conjunction with environmentally friendly lubricating compositions will further reduce the potential for environmental damage, yet provide optimum protection in very critical operations, thus, reducing drilling down time.

DETAILED DESCRIPTION OF SPECIFIC EMBODIMENTS

The inventors have found that oil field tool joints, drill collars, casing, tubing, line pipe, flow lines, subsurface production tools, and the like can be protected from seizing and abrading during make-up by first applying an anti-seize metallic coating to the thread surfaces where the anti-seize film is adapted to be in a bonded relationship to the surface of the threads and by second coating the anti-seize film protected thread surfaces with an environmentally friendly lubricating composition.

The methods of the present invention are particularly well suited for use in oil drilling operations. Although, the present invention is directed By primarily to oil field threaded tool, the methods of the present invention are broadly applicable to any threaded joint which is subjected to extremes of either stress, temperature, and/or pressure. Such other applications include, without limitation, chemical reactors, distillation towers, cracking towers, fluid bed reactors systems, and other equipment that has threaded connections that are subjected to extremes of stress, temperature, and/or pressure.

In its most basic form, the methods of the present invention include adhering a metallic anti-seize film to the thread surfaces and coating the film protected thread surfaces with an environmentally friendly lubricating composition to form an environmentally friendly anti-seize/lubricating system. This system is designed to protect and lubricate the threads during make-up and break-out and, yet, substantially reduce environmental contamination from both the anti-seize metal and the lubricant.

The step of adhering the anti-seize metallic film to the surface of the threads can be accomplished by a number of processes including, without limitation, burnishing, plating, sputtering, implanting, depositing, and bonding the anti-seize metallic film to the surface the threads. The adhering step can include at least one of these film forming processes. However, any combination of these processes also has usefulness in the methods of this invention.

Burnishing is a physical technique whereby a dissimilar metallic film is deposited onto a metallic surface. Additional information on burnishing can be found in U.S. Pat. Nos. 4,105,812; 4,063,346; 3,835,517; 3,736,167; 3,710,620; 2,600,367; 2,540,003, incorporated herein by reference. The metals useful for burnishing on the thread surfaces include, without limitation, copper, zinc, brass, bronze, aluminum, tin, nickel, stainless steel and mixtures thereof.

Plating and electroplating are techniques for depositing a metallic film onto a metallic surface. The technique can be achieved either by chemical means or electrical means, electroplating. Both techniques are well known in the art. However, additional information about plating and electroplating can be found in U.S. Pat. Nos. 5,271,546; 5,248,475; 5,242,572; 5,219,815; 5,217,751; 4,655,884; 4,654,230; 4,608,742; 4,407,149; 4,381,228; 4,379,738, incorporated herein by reference.

The adhering step of the present invention can include at least one plating step whereby an anti-seize metallic film is deposited onto the surfaces of the thread. The preferred plating process of the present invention comprises a first plating step depositing a bonding film onto the surface of the threads. Such bonding films can include films of a nickel, zinc, tin, brass, bronze, other zinc-copper alloys, cobalt, or mixtures thereof, or multiple films of mixture of these metals. Once the bonding film is plated on the thread surfaces, a second plating step deposits an anti-seize metallic film on top of the bonding film. The preferred anti-seize metals include copper, zinc, brass, bronze, aluminum, tin and mixtures thereof. The bonding film acts as an interposed layer that will simultaneously adhere to both the thread surface and to the anti-seize metal. Some anti-seize metals can not currently be bonded directly to the thread surfaces because the two metals are not compatible such as copper and iron or steel.

Sputtering generally involves depositing a specific metal or metallic composition on a surface using a beam of metal atoms or beam of a combination of different metal atoms resulting in the deposition of a specific metallic film or layer on the surface of the object being coated. The thickness of the film is typically controlled by exposure time to the beam. The layer thickness can range from monolayers to millimeters. The deposition is generally done at low pressure. Sputtering is also well known in the art.

Implanting generally involves depositing a specific metal or metallic composition on and into a surface using a beam of metal atoms or ions or a combination of different metal atoms or ions resulting in either a layer of a different alloy or a metallic film or layer on the surface. The implantation is generally done at low pressure. Implanting is also well known in the art.

Vapor deposition generally involves depositing a specific metal or metallic composition on a surface either by vaporizing the metal or combination of different metals atoms or by vaporizing a compound containing the metal or combination of metals such as vaporizing metal-carbonyl complexes or cluster resulting in the formation of a given metallic film or layer on the surface. The deposition is generally done at low to moderate pressure and the film thickness can vary from a monolayer to millimeters. or more. Vapor deposition is also well known in the art. However, additional information about vapor deposition can be found in U.S. Pat. Nos. 5,273,775; 4,803,127; 4,790,471; 4,501,776; 4,500,864, incorporated herein by reference.

Bonding generally involves the technique of using a resinous bonding composition containing a metal flake to adhere an anti-seize metallic film to the surface of the threads. The preferred bonding system comprising the steps of:

- coating the threads, prior to their make-up, with the solvent thinned resin based coating and bonding composition comprising a suspending agent, a bonding agent, a thinning agent, and a metallic flake;
- drying the coated threads for a time sufficient to bond the coating and bonding composition to the threads; and
- coating the threads, prior to their make-up, with an excess amount of the environmentally friendly lubricating composition.

The solvent thinned resin and bonding composition may be applied to the threads by simply brushing it on, or, alternatively, by including it in an aerosol spray system, and then simply spraying it onto the threads. The environmentally friendly lubricating composition may be applied to the threads, after the coating composition has dried, by simply brushing it on the threads.

Such a bonding method preferably includes the step of heating the threads after they have been coated with the solvent thinned resin based coating and bonding composition for a sufficient time to increase the resulting film's durability and resistance to galling. A propane torch may be used to heat the system. Such a heating step should enhance bonding.

The environmentally friendly lubricating composition used in conjunction with the adhered anti-seize film should be free or substantially free of environmentally hazardous substances while still providing friction resistance properties for favorable threaded connection protection, proper engagement of threaded members when subjected to API torque values, and acceptable resistance to downhole make-up, when used with the film formed from the coating and bonding composition of the present invention.

The environmentally friendly lubricating composition suitable for use in the methods of the present invention include, without limitation, synthetic or petroleum based fluids.

Preferred synthetic and natural based fluid compositions include those having a viscosity range of about 20–200 centistokes at about 40° C., including polyalphaolefins, polybutenes, polyolesters, vegetable oils, animal oils, and other essential oils having a viscosity within that range.

Preferred polyalphaolefins include those sold by Mobil Chemical Company as SHF fluids and those sold by Ethyl Corporation under the name ETHYLFLO. Such products include those specified as ETHYLFLO 162, 164, 166, 168, and 174, which are believed to be 6, 18, 32, 45 and 460 centistoke products, respectively. Particularly preferred is a blend of about 56% of the 460 centistoke product and about 44% of the 45 centistoke product. Preferred polybutenes include those sold by Amoco Chemical Company and Exxon Chemical Company under the trade names INDOPOL and PARAPOL, respectively. Particularly preferred is Amoco's INDOPOL L100. Preferred esters include neopentyl glycols, trimethylolpropanes, pentaerythritols, dipentaerythritols, and diesters such as dioctylsebacate (DOS), dioctylazelate (DOZ), and dioctyladipate.

Preferred petroleum based fluid compositions includes white mineral, paraffinic and MVI (medium viscosity index) naphthenic oils having a viscosity range of about 20–400 centistokes at 40° C. Preferred white mineral oils include those available from Witco Corporation, Arco Chemical Company, PSI and Penreco. Preferred paraffinic oils include solvent neutral oils available from Exxon Chemical Company, HVI (high viscosity index) neutral oils available from Shell Chemical Company, and solvent treated neutral oils available from Arco Chemical Company. Preferred MVI (medium viscosity index) naphthenic oils include solvent extracted coastal pale oils available from Exxon Chemical Company, MVI (medium viscosity index) extracted/acid treated oils available from Shell Chemical Company, and naphthenic oils sold under the names HydroCal and Calsol by Calumet.

Preferred vegetable oils include, without limitation, corn oil, olive oil, sunflower oil, sesame oil, peanut oil, and other vegetable oils and mixtures thereof. Preferred animal oils include, without limitation, tallow, mink oil, lard, and other animal oils, and mixtures thereof. Other essential oils will work as well. Of course, mixtures of all the above identified oils can be used as well.

The environmentally friendly lubricating composition may consist of a single fluid or a combination of several different fluids so long as the composition provides acceptable performance properties and complies with pertinent environmental regulations. Such a composition may also include minor amounts of naturally derived non-toxic solid fillers, such as, for example, calcium carbonate, tri-calcium phosphate, cerium fluoride, calcium fluoride, lanthium fluoride, tungsten and molybdenum disulfide, graphite, mica or talc. The composition may further include conventionally used rust, corrosion and/or oxidation inhibitors. If such additives are desired, they may be mixed into the compositions specified above using conventional mixing techniques.

The resinous bonding composition used in the methods of the present invention include suspending, bonding and thinning agents that are combined with a metallic flake, producing a composition that may be coated onto the threads of connecting members prior to make-up to yield a bonding anti-seize metallic film on the thread surfaces.

The suspending agent includes any material that may be used to uniformly suspend the composition's other components, in particular, the metallic flake. Preferred suspending agents include those conventionally used in paints and coatings, including, for example, thixotropic base materials, such as, but not limited to, those including cellulose, clay or silica.

The bonding agent includes any material that may bond the metallic flake to the threads. Preferably, the bonding agent also encapsulates the metallic flake, inhibiting that component's potential toxicity. Preferred bonding agents include organic resins, such as resins derived from acrylics, silicones, urethanes, alkyds, hydrocarbons, epoxies, and lacquers.

The thinning agent includes any material that ensures that the bonding agent will not harden prior to coating the composition onto the threads. Preferred thinning agents include organic solvents, such as aliphatic, aromatic, ketone, aldehyde, ester, acetate, ether, terpene and chlorinated and cyclopentasiloxane solvents.

The metallic flake includes those conventionally used for anti-seize compounds including, for example, copper, aluminum, tin, brass, bronze, nickel, stainless steel and mixtures thereof.

The suspending, bonding and thinning agents, and the metallic flake, may include a single component or a multiple number of components. For example, the thinning agent may include a combination of solvents having slow and fast evaporating rates. In such an embodiment of the present invention, the fast evaporating solvent inhibits the running and sagging of the film, while the slower evaporating solvent inhibits pin hole formation and promotes surface bonding.

The resinous bonding composition of the present invention may be made using conventional mixing techniques. The components of the composition should be sufficiently blended until they obtain a homogeneous mixture. For smaller quantities, blending may take place in a hobart or drum cowles mixer. For larger quantities, the composition may be made by combining the components in a large kettle mixer and milling them together to produce a homogeneous mixture.

The resinous bonding composition of the present invention may be a solvent thinned resin based composition. Such a composition preferably includes about 0.1–15% by weight of the suspending agent, about 1.0–15% by weight of the bonding agent, about 55–95% by weight of the thinning agent, and about 2.0–25% by weight of the metallic flake. More preferably, the solvent thinned resin based composition includes about 0.1–5.0% by weight of the suspending agent, which may include cellulose, clay or silica; about 2.0–10.0% by weight of the bonding agent, which may include an acrylic, a silicone, a urethane, an alkyd, a hydrocarbon, an epoxy, or a lacquer; about 65–90% by weight of the thinning agent, which may include an aliphatic, aromatic, ketone, aldehyde, ester, acetate, ether, terpene, chlorinated or cyclopentasiloxane solvent; and about 5.0–17% by weight of the metallic flake, which may include copper, aluminum, tin, brass, bronze, nickel or stainless steel.

Most preferably, such a composition includes about 1.0–3.0% by weight of an ethyl cellulose suspending agent, about 3.0–6.0% by weight of a thermosetting silicone resin bonding agent, about 79–89% by weight of a mixed solvent thinning agent, and about 7.0–12% by weight of micro-sized copper flakes. Such a composition should be applied to the threads of the connecting members and allowed to air-dry, preferably for at least one hour. Such a bonded copper film has been observed to provide favorable galling resistance. In addition, such a silicone resin coats the copper flake, rendering it substantially inactive, minimizing any potential toxicity.

The resinous bonding composition of the present invention may be an oil field threaded connection resinous bonding composition that includes:

about 1.0–5.0% by weight of a suspending agent selected from the group consisting of cellulose, clay and silica;

about 2.0–8.0% by weight of a bonding agent selected from the group consisting of an acrylic, a silicone, a urethane, an alkyd, a hydrocarbon, an epoxy, and a lacquer;

about 70–90% by weight of a thinning agent selected from the group consisting of aliphatic, aromatic, ketone, aldehyde, ester, acetate, ether, terpene, chlorinated and cyclopentasiloxane solvents; and about 5.0–20% by weight of a metallic flake selected from the group consisting of copper, aluminum, tin, brass, bronze, nickel and stainless steel.

Such an oil field threaded connection resinous bonding composition preferably includes about 1.0–3.0% by weight of an ethyl cellulose suspending agent, about 3.0–6.0% by weight of a thermosetting silicone resin bonding agent, about 79–89% by weight of an aromatic thinning agent, and about 7.0–12% by weight of a copper flake.

The following examples are illustrative of the resinous bonding composition of the present invention. It will be appreciated, of course, that the proportions of components are variable. Selection of different suspending, bonding and thinning agents, and metallic flakes, and selection of different weight percentages of such components, can be readily made. Moreover, additional materials that may be added to the composition are a matter of design choice. The examples are thus not in any way to be construed as limitations upon the scope of the present invention.

EXAMPLE 1

| Component | Percentage by weight of total composition |
|---|---|
| suspending agent[1] | 2% |
| bonding agent[2] | 6% |
| thinning agent[3] | 84% |
| metallic flake[4] | 8% |

[1]Ethyl cellulose, sold under the trade name EHEC by Aqualon.
[2]Thermosetting silicone resin, sold under the trade name Silikophen P80/X by Tego Chemie Service USA.
[3]A mixture of one part by weight xylene, such as may be obtained from Hill Petroleum, and two parts by weight 1:1:1 trichloroethane, sold under the trade name Chlorothene by Du Pont.
[4]Copper flake, sold by Atlantic Powdered Metals.

TABLE I lists certain properties for the resinous bonding composition of EXAMPLE 1.

TABLE I

| | |
|---|---|
| Color | Copper Colored fluid with characteristic solvent odor |
| Appearance: | A suspension of micro-sized copper flakes |
| Density: | 10.0 pounds per gallon |

TABLE I-continued

| | |
|---|---|
| Wt. % Solids: | 14.0 |
| Flash Point: | 80° F. |
| Typical Coverage: | 2,400 sq. in. per 12 ounce aerosol can<br>43,500 sq. in. per 1 gallon-bulk |
| Pencil Hardness, ASTM: | 1 to 24 hr. ambient = 4B min.<br>3 weeks @ ambient = 2B min.<br>1 hr. @ 200° F. = 3B min.<br>24 hr. @ 200° F. = 1H min. |

EXAMPLE 2

| Component | Percentage by weight of total composition |
|---|---|
| suspending agent[5] | 1.8% |
| bonding agent[6] | 4.4% |
| thinning agent[7] | 82.2% |
| metallic flake[8] | 11.6% |

[5]Ethyl cellulose, sold under the trade name EHEC by Aqualon.
[6]Thermosetting silicone resin, sold under the trade name Silikophen P80/X by Tego Chemie Service USA.
[7]A mixture of one part by weight xylene, such as may be obtained from Hill Petroleum, and two parts by weight 1:1:1 trichloroethane, sold under the trade name Chlorothene by Du Pont.
[8]Copper flake, sold by Atlantic Powdered Metals.

TABLE II lists certain properties for the composition of EXAMPLE 2.

TABLE II

| | |
|---|---|
| Color: | Copper Colored fluid with characteristic solvent odor |
| Appearance: | A suspension of micro-sized copper flakes |
| Density: | 10.42 pounds per gallon |
| Wt. % Solids: | 17.0 |
| Flash Point: | 80° F. |
| Typical Coverage: | 2,400 sq. in. per 12 ounce aerosol can<br>43,500 sq. in. per 1 gallon-bulk |
| Pencil Hardness, ASTM: | 1 to 24 hr. ambient = 4B min.<br>3 weeks @ ambient = 2B min.<br>1 hr. @ 200° F. = 3B min.<br>24 hr. @ 200° F. = 1H min. |

Additional advantages and modifications will readily occur to those skilled in the art. The invention in its broader aspects is therefore not limited to the specific details and the illustrative examples as shown and described.

We claim:

1. A method for protecting threaded connections with an anti-seize/lubricating system, the method comprising the steps of:

a) coating the threads, prior to their make-up, with a solvent thinned resin based bonding composition comprising a suspending agent, a bonding agent, a thinning agent, and a metallic flake;

b) drying the coated threads for a time sufficient to bond the bonding composition to the threads to form an anti-seize film on the thread; and c) coating the threads having the anti-seize film bonded thereto, prior to their make-up, with a fluid lubricating composition, where the anti-seize film and the lubricating composition form the anti-seize/lubricating system.

2. The method of claim 1, wherein the solvent thinned resin based bonding composition comprises:

from about 0.1–5.0% by weight of the suspending agent;

from about 2.0–10.0% by weight of the bonding agent;

from about 65–90% by weight of the thinning agent; and from about 5.0–17% by weight of the metallic flake.

3. The method of claim 1, wherein the solvent thinned resin based bonding composition comprises:

from about 1.0–3.0% by weight of the suspending agent;

from about 3.0–6.0% by weight of the bonding agent;

from about 79–89% by weight of the thinning agent; and from about 7.0–12% by weight of the metallic flake.

4. The method of claim 1, wherein the lubricating composition is selected from the group consisting of a synthetic fluid, a petroleum fluid, a vegetable oil, an animal oil, and mixtures thereof.

5. The method of claim 1, wherein the suspending agent is selected from the group consisting of cellulose, clay and silica.

6. The method of claim 1, wherein the bonding agent is selected from the group consisting of an acrylic, a silicone, a urethane, an alkyd, a hydrocarbon, an epoxy, and a lacquer.

7. The method of claim 1, wherein the thinning agent is selected from the group consisting of aliphatic, aromatic, ketone, aldehyde, ester, acetate, ether, terpene, chlorinated and cyclopentasiloxane solvents.

8. The method of claim 1, wherein the metallic flake is selected from the group consisting of copper, aluminum, tin, brass, bronze, nickel and stainless steel.

9. The method of claim 2, wherein the suspending agent is selected from the group consisting of cellulose, clay and silica, the bonding agent is selected from the group consisting of an acrylic, a silicone, a urethane, an alkyd, a hydrocarbon, an epoxy, and a lacquer, the thinning agent is selected from the group consisting of aliphatic, aromatic, ketone, aldehyde, ester, acetate, ether, terpene, chlorinated and cyclopentasiloxane solvents, the metallic flake is selected from the group consisting of copper, aluminum, tin, brass, bronze, nickel and stainless steel, and the lubricating composition is selected from the group consisting of a synthetic fluid, a petroleum fluid, a vegetable oil, an animal oil, and mixtures thereof.

10. The method of claim 3, wherein the suspending agent is selected from the group consisting of cellulose, clay and silica, the bonding agent is selected from the group consisting of an acrylic, a silicone, a urethane, an alkyd, a hydrocarbon, an epoxy, and a lacquer, the thinning agent is selected from the group consisting of aliphatic, aromatic, ketone, aldehyde, ester, acetate, ether, terpene, chlorinated and cyclopentasiloxane solvents, the metallic flake is selected from the group consisting of copper, aluminum, tin, brass, bronze, nickel and stainless steel, and the lubricating composition is selected from the group consisting of a synthetic fluid, a petroleum fluid, a vegetable oil, an animal oil, and mixtures thereof.

11. The method of claim 1, further comprising the step of:

depositing onto the thread, prior to the first coating step, a metallic bonding film.

12. The method of claim 11, wherein the bonding film is selected from the group consisting of nickel, zinc, tin, a zinc-copper alloy, cobalt, and mixtures thereof.

13. A method for protecting threaded connections with an anti-seize/lubricating system, the method comprising the steps of:

a) depositing onto the threads a metallic bonding film;

b) coating the threads having the metallic bonding film deposited thereon with a solvent thinned resin based bonding composition comprising a suspending agent, a bonding agent, a thinning agent, and a metallic flake;

c) drying the coated threads for a time sufficient to bond the bonding composition to the metallic bonding film on the threads to form anti-seize film coated threads; and d) coating the anti-seize film coated threads with a fluid lubricating composition, where the anti-seize film and the lubricating composition form the anti-seize/lubricating system.

14. The method of claim 13, wherein solvent thinned resin based bonding composition comprises:

from about 0.1–5.0% by weight of the suspending agent;

from about 2.0–10.0% by weight of the bonding agent;

from about 65–90% by weight of the thinning agent; and from about 5.0–17% by weight of the metallic flake.

15. The method of claim 13, wherein the solvent thinned resin based bonding composition comprises:

from about 1.0–3.0% by weight of the suspending agent;

from about 3.0–6.0% by weight of the bonding agent;

from about 79–89% by weight of the thinning agent; and from about 7.0–12% by weight of the metallic flake.

16. The method of claim 13, wherein the suspending agent is selected from the group consisting of cellulose, clay and silica, the bonding agent is selected from the group consisting of an acrylic, a silicone, a urethane, an alkyd, a hydrocarbon, an epoxy, and a lacquer, the thinning agent is selected from the group consisting of aliphatic, aromatic, ketone, aldehyde, ester, acetate, ether, terpene, chlorinated and cyclopentasiloxane solvents, the metallic flake is selected from the group consisting of copper, aluminum, tin, brass, bronze, nickel and stainless steel, the lubricating composition is selected from the group consisting of a synthetic fluid, a petroleum fluid, a vegetable oil, an animal oil, and mixtures thereof, and the bonding film is selected from the group consisting of nickel, zinc, tin, a zinc-copper alloy, cobalt, and mixtures thereof.

17. The method of claim 14, wherein the suspending agent is selected from the group consisting of cellulose, clay and silica, the bonding agent is selected from the group consisting of an acrylic, a silicone, a urethane, an alkyd, a hydrocarbon, an epoxy, and a lacquer, the thinning agent is selected from the group consisting of aliphatic, aromatic, ketone, aldehyde, ester, acetate, ether, terpene, chlorinated and cyclopentasiloxane solvents, the metallic flake is selected from the group consisting of copper, aluminum, tin, brass, bronze, nickel and stainless steel, the lubricating composition is selected from the group consisting of a synthetic fluid, a petroleum fluid, a vegetable oil, an animal oil, and mixtures thereof, and the bonding film is selected from the group consisting of nickel, zinc, tin, a zinc-copper alloy, cobalt, and mixtures thereof.

18. The method of claim 15, wherein the suspending agent is selected from the group consisting of cellulose, clay and silica, the bonding agent is selected from the group consisting of an acrylic, a silicone, a urethane, an alkyd, a hydrocarbon, an epoxy, and a lacquer, the thinning agent is selected from the group consisting of aliphatic, aromatic, ketone, aldehyde, ester, acetate, ether, terpene, chlorinated and cyclopentasiloxane solvents, the metallic flake is selected from the group consisting of copper, aluminum, tin, brass, bronze, nickel and stainless steel, the lubricating composition is selected from the group consisting of a synthetic fluid, a petroleum fluid, a vegetable oil, an animal oil, and mixtures thereof, and the bonding film is selected from the group consisting of nickel, zinc, tin, a zinc-copper alloy, cobalt, and mixtures thereof.

* * * * *